US009745989B2

(12) United States Patent
Tsutsui

(10) Patent No.: US 9,745,989 B2
(45) Date of Patent: Aug. 29, 2017

(54) TURBO-MOLECULAR PUMP

(71) Applicant: SHIMADZU CORPORATION, Kyoto (JP)

(72) Inventor: Shingo Tsutsui, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 360 days.

(21) Appl. No.: 14/417,983

(22) PCT Filed: Sep. 24, 2012

(86) PCT No.: PCT/JP2012/074390

§ 371 (c)(1),
(2) Date: Jan. 28, 2015

(87) PCT Pub. No.: WO2014/045438

PCT Pub. Date: Mar. 27, 2014

(65) Prior Publication Data

US 2015/0226229 A1 Aug. 13, 2015

(51) Int. Cl.

| | |
|---|---|
| ***F04D 19/04*** | (2006.01) |
| ***F04D 29/58*** | (2006.01) |
| ***F04D 27/00*** | (2006.01) |

(52) U.S. Cl.

CPC ..... *F04D 27/006* (2013.01); *F04D 19/042* (2013.01); *F04D 19/044* (2013.01); *F04D 29/582* (2013.01); *F04D 29/584* (2013.01); *F04D 29/5853* (2013.01)

(58) Field of Classification Search

CPC .. F04D 29/582; F04D 29/5853; F04D 19/044; F04D 29/584; F04D 19/042; F04D 27/006; F01D 11/24

USPC ..... 415/47, 177; 417/313, 423.8, 423.4

See application file for complete search history.

(56) References Cited

U.S. PATENT DOCUMENTS

2002/0039533 A1 4/2002 Miyamoto

FOREIGN PATENT DOCUMENTS

| | | |
|---|---|---|
| EP | 0 855 517 A2 | 7/1998 |
| JP | 04-164187 | 6/1992 |
| JP | 10-205486 | 8/1998 |
| JP | 2002-180988 | 6/2002 |
| JP | 2005-083271 | 3/2005 |
| JP | 3930297 | 3/2007 |

(Continued)

OTHER PUBLICATIONS

Japanese Office Action for corresponding Japanese Application No. 2014-536533 issued on Sep. 1, 2015 (with English translation).

(Continued)

*Primary Examiner* — Marina Tietjen

(74) *Attorney, Agent, or Firm* — Renner Otto Boisselle & Sklar

(57) ABSTRACT

A turbo-molecular pump comprises: a rotor; stationary blades; a stator; a plurality of spacers; a heater disposed on the base; a temperature sensor for detecting a temperature of the stator; and a temperature regulation section for on/off controlling the heater based on a temperature detected by the temperature sensor to regulate the temperature of the stator so as to be a reaction product accumulation prevention temperature. At least one spacer arranged on a base side of the plurality of spacers is cooled by coolant, and the turbo-molecular pump further comprises a heat insulation member disposed between the base and the spacer arranged on the base.

6 Claims, 9 Drawing Sheets

(56) References Cited

FOREIGN PATENT DOCUMENTS

| | | |
|---|---|---|
| JP | 2008-038764 | 2/2008 |
| JP | 2011-127483 | 6/2011 |
| JP | 3168845 | 6/2011 |

OTHER PUBLICATIONS

Chinese Office Action dated Jan. 29, 2016 for corresponding Chinese Application No. 201280073600.X (English translation).
International Search Report for corresponding International Application No. PCT/JP2012/074390 mailed Oct. 23, 2012.

TURBO-MOLECULAR PUMP

TECHNICAL FIELD

The present invention relates to a turbo-molecular pump provided with a turbine blade section and a screw groove pump section.

BACKGROUND ART

Conventionally, in a dry etching process, a CVD process, or the like in semiconductor manufacturing processes, processing is performed while supplying a large amount of gas in order to perform the processes at high speed. Generally, a turbo-molecular pump that is provided with a turbine blade section and a screw groove pump section is used for evacuating a process chamber in a dry etching process, a CVD process, or the like. When a large amount of gas is discharged in a turbo-molecular pump, frictional heat generated in moving blades (rotor blades) is transmitted from the moving blades to stator blades (stationary blades), spacers, and a base in this order, and then released into cooling water in a cooling pipe disposed on the base.

However, when a larger amount of gas is discharged, the temperature of a rotor that includes the moving blades may disadvantageously exceed an allowable temperature. When the temperature of the rotor exceeds the allowable temperature, the speed of expansion by creep becomes higher. As a result, the rotor may disadvantageously come into contact with a stator within a shorter period than a designed life.

Further, in this kind of semiconductor manufacturing apparatus, a reaction product is generated in etching or CVD, and the reaction product is likely to be accumulated on a screw stator of the screw groove pump section. A gap between the screw stator and the rotor is extremely small. Thus, when the reaction product is accumulated on the screw stator, the screw stator and the rotor may be stuck to each other. As a result, the rotor may not be able to start rotating.

Therefore, in the invention described in Patent Document 1, a turbo-molecular pump is provided with a first cooling water passage which cools rotor blades and a device for regulating the temperature of a screw stator (a heater and a second cooling water passage). The first cooling water passage is disposed on an outer peripheral surface of a pump case, and cools the pump case to thereby cool stationary blades housed inside the pump case. In this manner, providing the first cooling water passage and the temperature regulation device lowers the temperature of the rotor and prevents the accumulation of a reaction product on the screw stator.

PRIOR ART DOCUMENT

Patent Document

Patent Document 1: JP 3930297 B1

SUMMARY OF THE INVENTION

Problems to be Solved by the Invention

However, along with an increase in the size of a wafer to be processed, the flow rate of gas that should be discharged by the turbo-molecular pump increases, and the amount of heat generated along with the discharge of gas also increases. Therefore, a method for cooling the pump case as described in Patent Document 1 does not have sufficient cooling capacity to cool the stationary blades. Further, the temperature of the base to which the pump case is fixed becomes high by temperature regulation. Thus, heat flowing into the pump case from the base is a factor that inhibits cooling of the stationary blades.

Solutions to the Problems

In a first embodiment of the present invention, a turbo-molecular pump comprises: a rotor having a plurality of stages of rotor blades and a cylindrical section; a plurality of stages of stationary blades alternately arranged with respect to the plurality of stages of rotor blades; a stator arranged with a gap from the cylindrical section; a plurality of spacers stacked on a base to which the stator is fixed, and positioning the plurality of stages of stationary blades; a heater disposed on the base; a temperature sensor for detecting a temperature of the stator; and a temperature regulation section for on/off controlling the heater based on a temperature detected by the temperature sensor to regulate the temperature of the stator so as to be a reaction product accumulation prevention temperature. At least one spacer arranged on abase side of the plurality of spacers is cooled by coolant, and the turbo-molecular pump further comprises a heat insulation member disposed between the base and the spacer arranged on the base.

In a second embodiment of the present invention, preferably the spacer cooled by the coolant includes a spacer section stacked together with the other spacers and a cooling section having a first coolant flow passage through which coolant flows, and a coolant supply section and a coolant discharge section of the first coolant flow passage of the cooling section are arranged on a pump atmospheric side.

In a third embodiment of the present invention, preferably the turbo-molecular pump further comprises a base cooling section having a second coolant flow passage through which coolant flows, and cooling the base. The temperature regulation section controls ON/OFF of the heater and the amount of coolant supplied to the base cooling section based on a temperature detected by the temperature sensor to regulate the temperature of the stator.

In a fourth embodiment of the present invention, preferably the turbo-molecular pump further comprises a three-way valve to which the coolant discharge section of the first coolant flow passage, a coolant supply side of the second coolant flow passage, and a coolant pipe bypassing the second coolant flow passage are connected, switching inflow destination of coolant discharged from the coolant discharge section of the first coolant flow passage between the coolant supply side of the second coolant flow passage and the coolant pipe bypassing the second coolant flow passage. The temperature regulation section switches the three-way valve to the coolant pipe and turns ON the heater when a temperature detected by the temperature sensor is less than the reaction product accumulation prevention temperature, and the temperature regulation section switches the three-way valve to the coolant supply side of the second coolant flow passage and turns OFF the heater when a temperature detected by the temperature sensor is equal to or more than the reaction product accumulation prevention temperature.

In a fifth embodiment of the present invention, preferably the spacer located nearest to the base of the plurality of spacers stacked on the base is cooled by coolant.

In a sixth embodiment of the present invention, preferably the turbo-molecular pump further comprises a pump case fixed to the base with fixation bolts, the pump case holding the plurality of spacers stacked on the base between the pump case and the base. The heat insulation member is a heat insulation washer which is attached to the fixation bolts and arranged between the spacer cooled by the coolant and the base.

Effects of the Invention

The present invention makes it possible to improve the exhaust flow rate and prevent the accumulation of a reaction product.

EMBODIMENTS OF THE INVENTION

Figure 1:
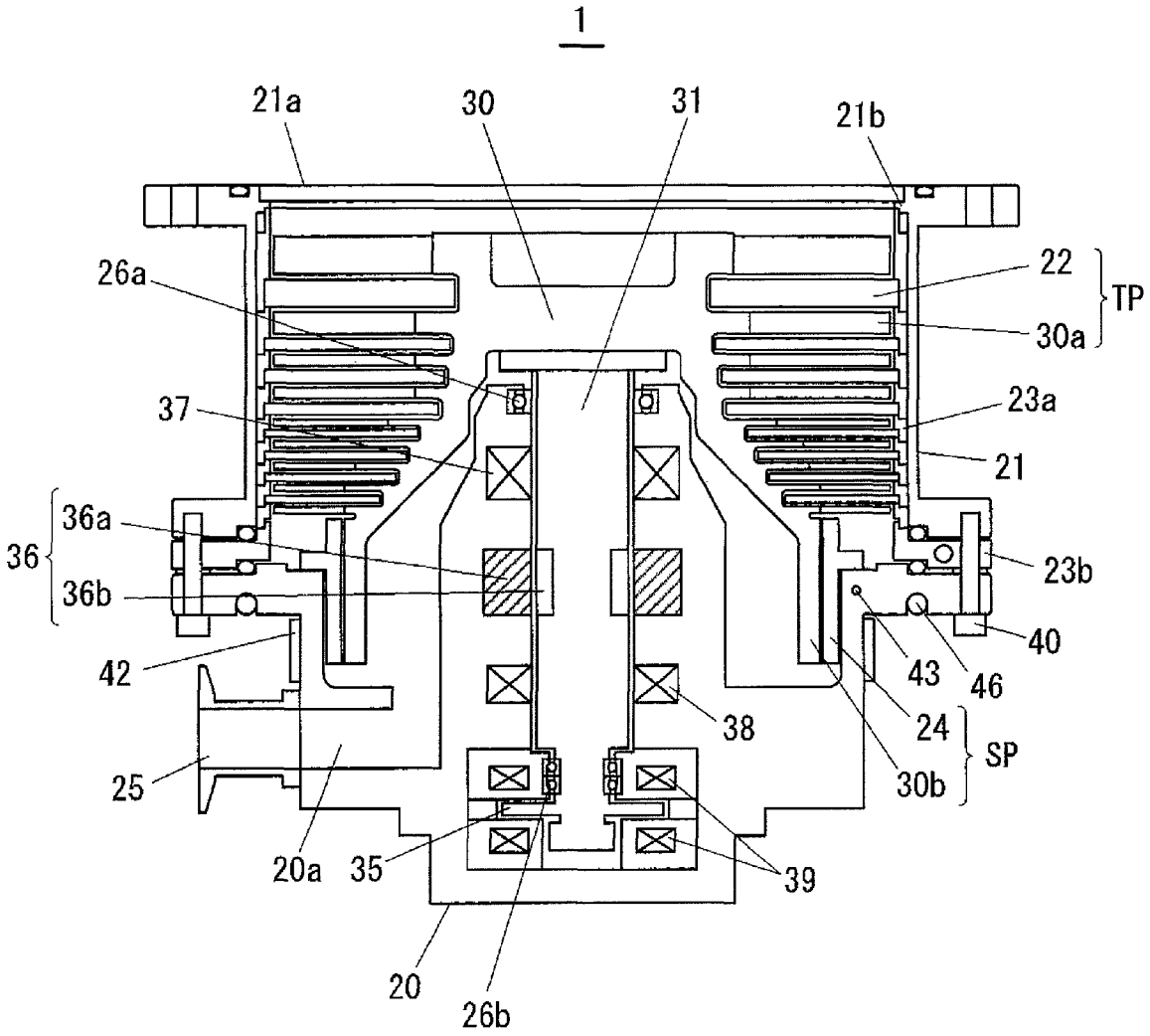
FIG. 1 is a cross-sectional view showing a schematic configuration of a pump main body 1.

Hereinafter, an embodiment of the present invention will be described with reference to the drawings. FIG. 1 is a diagram showing a schematic configuration of a turbo-molecular pump according to the present invention. The turbo-molecular pump includes a pump main body 1 shown in FIG. 1 and a control unit (not shown) which controls the drive of the pump main body 1. The control unit is provided with a main controller which controls the entire pump main body, a motor controller which drives a motor 36 (described below), a bearing controller which controls magnetic bearings provided in the pump main body 1, a temperature regulation controller 511 (described below), or the like.

In the following description, an active magnetic bearing turbo-molecular pump will be described as an example. However, the present invention can also be applied, for example, to passive magnetic bearing turbo-molecular pumps using a permanent magnet or turbo-molecular pumps using a mechanical bearing.

A rotor 30 has a plurality of stages of rotor blades 30*a* and a cylindrical section 30*b* which is formed on an exhaust downstream side with respect to the rotor blades 30*a*. The rotor 30 is fastened to a shaft 31 as a rotor shaft. The rotor 30 and the shaft 31 together constitute a pump rotor body. The shaft 31 is supported in a contactless manner by magnetic bearings 37, 38, and 39 which are disposed on a base 20. Electromagnets of the axial magnetic bearing 39 are arranged so as to sandwich a rotor disk 35 which is disposed on the lower end of the shaft 31 in the axial direction.

The pump rotor body (the rotor 30 and the shaft 31) which is magnetically levitated in a freely rotatable manner by the magnetic bearings 37 to 39 is driven to rotate at high speed by a motor 36. For example, a three-phase blushless motor is used as the motor 36. A motor stator 36*a* of the motor 36 is disposed on the base 20, and a motor rotor 36*b* which is provided with a permanent magnet is disposed on the shaft 31. Emergency mechanical bearings 26*a* and 26*b* support the shaft 31 when the magnetic bearings are not operating.

A plurality of stages of stationary blades 22 are each arranged between the vertically adjacent rotor blades 30*a*. The plurality of stages of stationary blades 22 are positioned on the base 20 by a plurality of spacers 23*a* and a cooling spacer 23*b*. Each of the plurality of stages of stationary blades 22 is sandwiched by the spacers 23*a*. The cooling spacer 23*b* is arranged on the lowest stage of a stacked body of the plurality of stages of stationary blades 22 and the spacers 23*a*. A detailed configuration of a portion in which the cooling spacer 23*b* is arranged will be described below. When a case 21 is fixed to the base 20 with bolts 40, a stacked body of the stationary blades 22, the spacers 23*a*, and the cooling spacer 23*b* is fixed to the base 20 so as to be sandwiched between an upper end locking section 21*b* of the case 21 and the base 20. As a result, the plurality of stages of stationary blades 22 are positioned in the axial direction (vertical direction in the drawing).

The turbo-molecular pump shown in FIG. 1 is provided with a turbine blade section TP which includes the rotor blades 30*a* and the stationary blades 22 and a screw groove pump section SP which includes the cylindrical section 30*b* and a screw stator 24. Although a screw groove is formed on the screw stator 24 in the present embodiment, the screw groove may be formed on the cylindrical section 30*b*. An exhaust port 25 is attached to an exhaust opening 20*a* of the base 20. A back pump is connected to the exhaust port 25. By driving the rotor 30 to rotate at high speed by the motor 36 while magnetically levitating the rotor 30, gas molecules in a suction opening 21*a* are discharged toward the exhaust port 25.

A base cooling pipe 46, a heater 42, and a temperature sensor 43 for controlling the temperature of the screw stator 24 are disposed on the base 20. The temperature regulation for the screw stator 24 will be described below. In the example shown in FIG. 1, the heater 42 which is configured of a band heater is wound around a side face of the base 20. However, a sheathed heater may be embedded in the base 20. As the temperature sensor 43, for example, a thermistor, a thermocouple, or a platinum temperature sensor is used.

Figure 2:
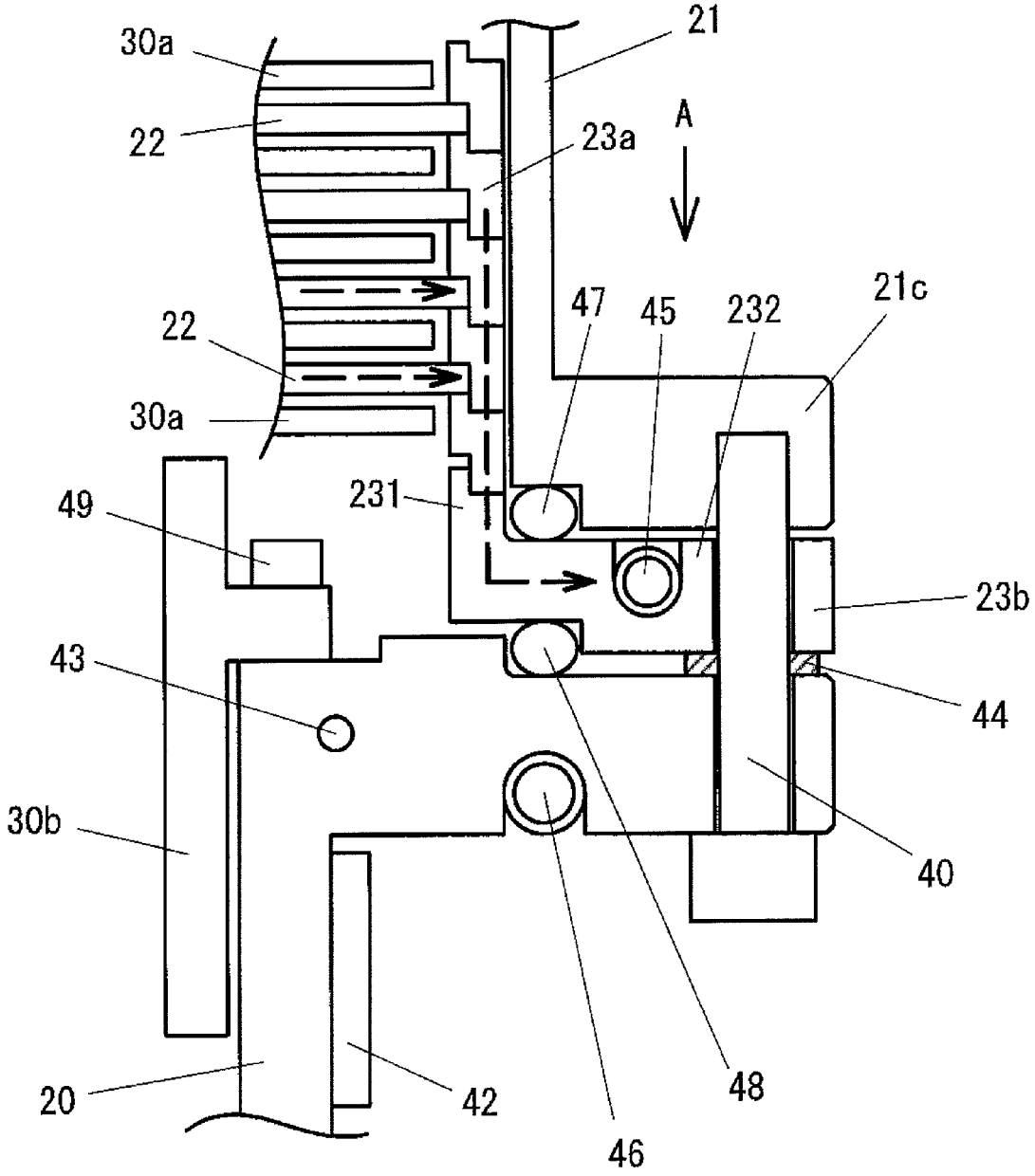
FIG. 2 is an enlarged view of a portion of a cooling spacer 23*b* of FIG. 1.

FIG. 2 is an enlarged view of the portion in which the cooling spacer 23*b* is disposed in FIG. 1. As described above, the stacked body formed by alternately stacking the plurality of stages of stationary blades 22 and the spacers 23*a* on each other is mounted on the cooling spacer 23*b*. The cooling spacer 23*b* includes a flange section 232 in which a spacer cooling pipe 45 is provided and a spacer section 231 which is stacked together with the other spacers 23*a*.

Figure 3:
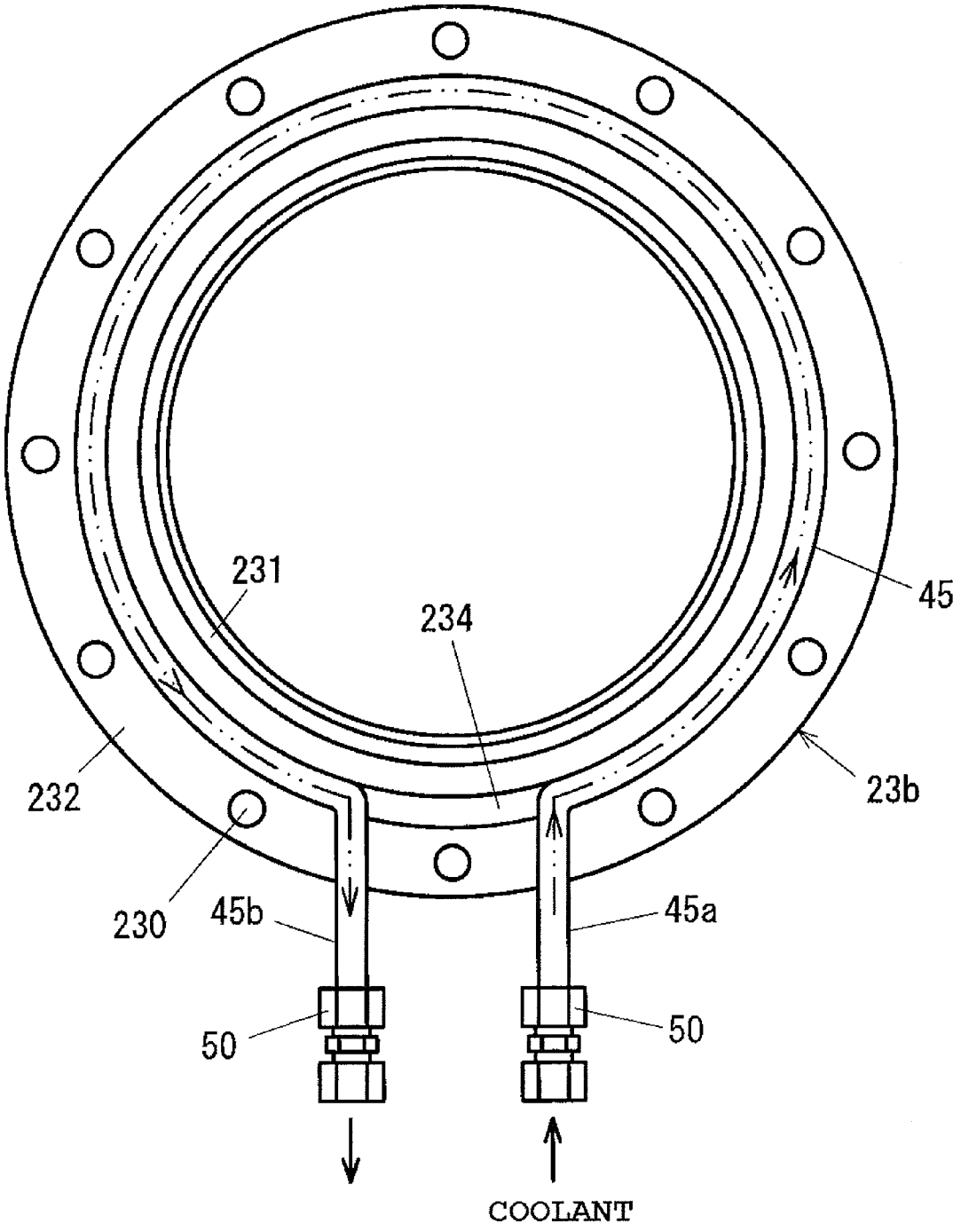
FIG. 3 is a diagram of the cooling spacer 23*b* viewed from direction A of FIG. 2.

FIG. 3 is a plan view of the cooling spacer 23*b* of FIG. 2 viewed from direction A. As with the spacers 23*a*, the cooling spacer 23*b* is a ring-like member. A circular groove 234 which houses the spacer cooling pipe 45 is formed on the flange section 232. A plurality of bolt fastening through holes 230 are formed on an outer peripheral side of the groove 234. A gap between the spacer cooling pipe 45 and the groove 234 is filled with thermal conductive grease, high thermal conductive resin, solder, and the like.

The spacer cooling pipe 45 is bent into a generally circular shape, so that a coolant supply section 45*a* and a coolant discharge section 45*b* of the spacer cooling pipe 45 are extracted to a lateral side of the cooling spacer 23*b*. A piping joint 50 is attached to each of the coolant supply section 45*a* and the coolant discharge section 45*b*. Coolant (cooling water, for example) flows into the spacer cooling pipe 45 from the coolant supply section 45*a*, then circularly flows along the spacer cooling pipe 45, and is then discharged from the coolant discharge section 45*b*.

Referring back to FIG. 2, the case 21 is attached so that a flange 21*c* faces the flange section 232 of the cooling spacer 23*b*, and fixed to the base 20 with the bolts 40. Heat insulation washers 44 each of which functions as a heat insulation member are disposed on the respective bolts 40. The heat insulation washers 44 are arranged between the base 20 and the cooling spacer 23*b* to thermally insulate the base 20 and the cooling spacer 23*b* from each other. As the material used in the heat insulation washers 44, a material having a thermal conductivity that is lower than the thermal conductivity of the material used in the spacers 23*a* and the cooling spacer 23*b* (aluminum, for example) is used. For example, stainless is desirably used among metals. On the other hand, a resin having a heat resistant temperature of 120° C. or higher (an epoxy resin, for example) is desirably used among nonmetals.

A vacuum seal 48 is disposed between the flange section 232 of the cooling spacer 23*b* and the base 20. Also, a vacuum seal 47 is disposed between the flange section 232 and the flange 21*c*. The screw stator 24 is fixed to the base 20 with bolts 49. The base 20 is heated by the heater 42, and cooled by the base cooling pipe 46 through which coolant flows. The temperature sensor 43 is arranged on the base 20 near a position to which the screw stator 24 is fixed.

The cooling spacer 23*b* is cooled by coolant flowing inside the spacer cooling pipe 45. Thus, heat of the stationary blades 22 is first transferred to the spacers 23*a* and then to the cooling spacer 23*b* as indicated by broken line arrows and released into the coolant inside the spacer cooling pipe 45. On the other hand, in discharge of gas producing a reaction product that is likely to be accumulated, heating performed by the heater 42 and cooling performed by the base cooling pipe 46 are controlled to make the temperature of the screw stator 24 equal to or higher than a temperature that does not cause accumulation of the reaction product. As the temperature that does not cause the accumulation of the reaction product, a temperature equal to or higher than the sublimation temperature of the reaction product is employed.

Therefore, the heat insulation washers 44 are arranged between the cooling spacer 23*b* and the base 20 to prevent heat from flowing toward the stationary blades 22 from the base 20 in a high temperature state. Further, as can be seen from FIG. 2, a gap is formed between the cooling spacer 23*b* and the flange 21*c* through the vacuum seal 47. Thus, heat never flows from the case 21 into the cooling spacer 23*b*.

Figure 4:
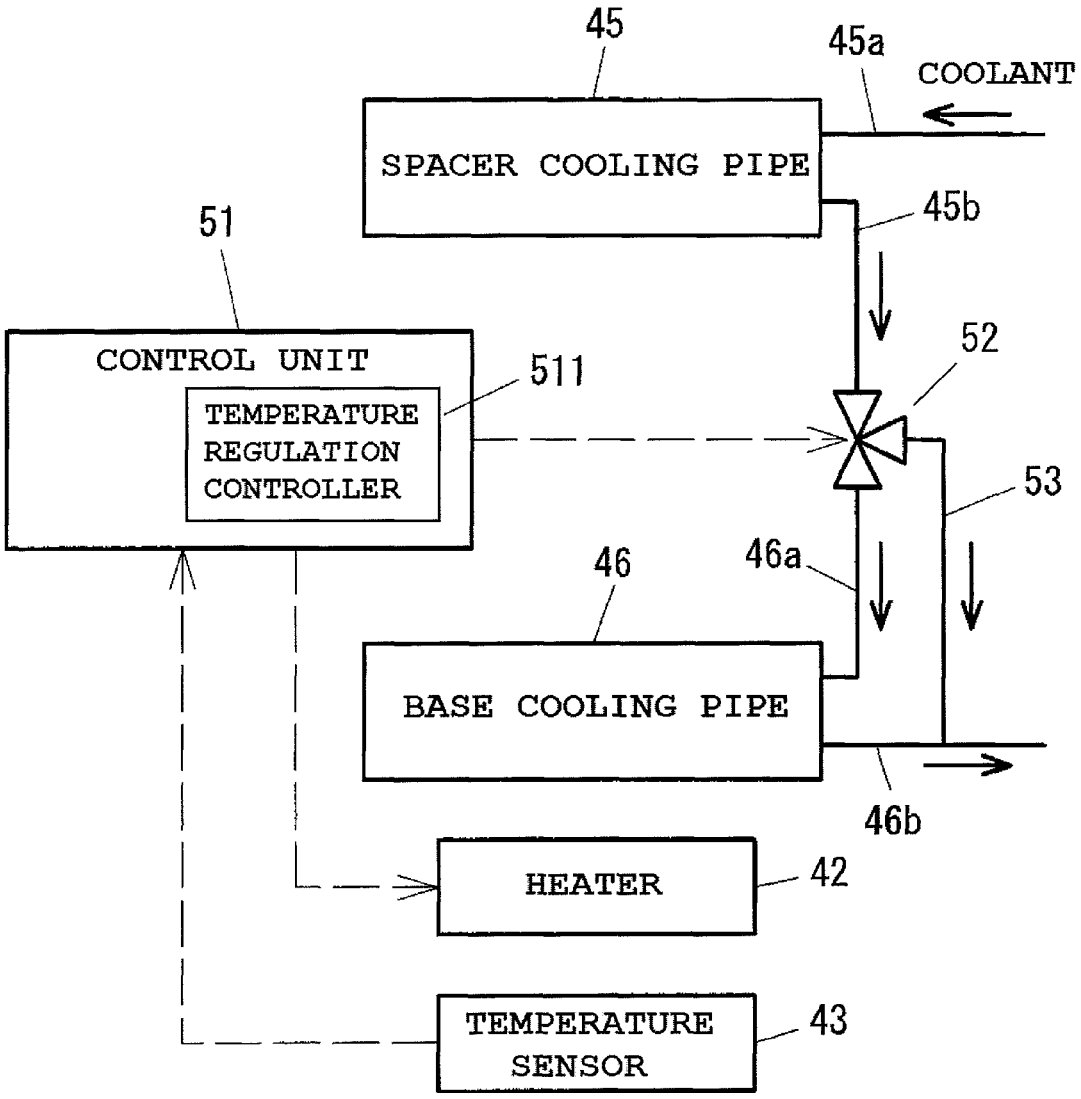
FIG. 4 is a diagram illustrating a temperature regulation operation.

FIG. 4 is a diagram illustrating a cooling piping system and a temperature regulation operation. The coolant discharge section 45*b* of the spacer cooling pipe 45, a coolant supply section 46*a* of the base cooling pipe 46, and a bypass pipe 53 are connected to a three-way valve 52. An end of the bypass pipe 53, the end not being connected to the three-way valve 52, is connected to a coolant discharge section 46*b* of the base cooling pipe 46. The switching of the three-way valve 52 is controlled by the temperature regulation controller 511 of a control unit 51 which controls the drive of the pump main body 1. The temperature regulation controller 511 controls the switching of the three-way valve 52 and ON/OFF of the heater 42 based on a temperature detected by the temperature sensor 43.

When a temperature detected by the temperature sensor 43 is less than a predetermined temperature, the temperature regulation controller 511 switches an outflow side of the three-way valve 52 to the bypass pipe 53 to bypass coolant from the three-way valve 52 to the coolant discharge section 46*b*. Further, the heater 42 is turned ON. As a result, the base 20 is heated by the heater 42, which increases the temperature of the base 20 and the temperature of the screw stator 24.

The predetermined temperature is equal to or higher than the sublimation temperature of the reaction product described above, and previously stored in a storage section (not shown) in the temperature regulation controller 511. In the example illustrated in FIG. 2, the temperature sensor 43 is disposed on the base 20. Therefore, the predetermined temperature is set by taking a difference in temperature between a portion in which the temperature sensor 43 is disposed and the screw stator 24 into consideration.

When a temperature detected by the temperature sensor 43 is equal to or higher than the predetermined temperature, the temperature regulation controller 511 turns OFF the heater 42 and switches the outflow side of the three-way valve 52 to the coolant supply section 46*a* of the base cooling pipe 46 to thereby supply the coolant to the base cooling pipe 46. Performing such temperature regulation control by the temperature regulation controller 511 maintains the screw stator 24 at a temperature equal to or higher than the sublimation temperature of the reaction product, thereby making it possible to prevent the accumulation of the reaction product.

On the other hand, since the coolant is constantly supplied to the spacer cooling pipe 45, the stationary blades 22 are maintained at a low temperature by the cooling spacer 23*b*. As a result, heat release from the rotor blades 30*a* to the stationary blades 22 by radiation is accelerated, thereby making it possible to maintain the rotor 30 at a lower temperature than a conventional one. As a result, it is possible to increase the exhaust flow rate. A temperature level in the spacer cooling pipe 45 is lower than a temperature level in the base cooling pipe 46. Thus, the coolant is preferably circulated from the spacer cooling pipe 45 to the base cooling pipe 46.

Figure 5:
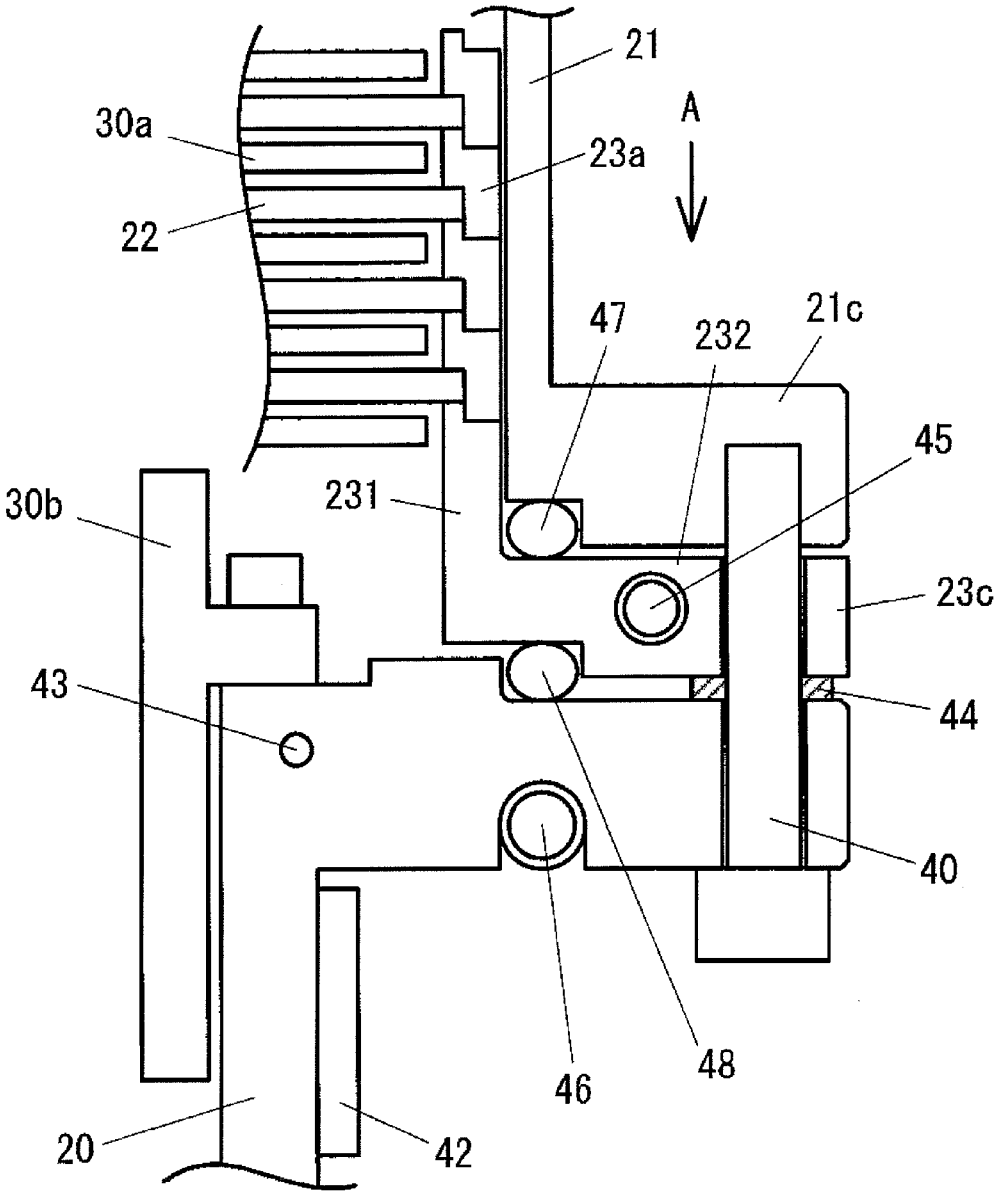
FIG. 5 is a diagram showing a first modification of the cooling spacer.

FIG. 5 is a diagram showing a first modification of the cooling spacer 23*b* shown in FIG. 2. The cooling spacer 23*b* shown in FIG. 2 and the spacer 23*a* arranged immediately above the cooling spacer 23*b* are integrated with each other to form a cooling spacer 23*c* shown in FIG. 5. The other configurations are the same as the configurations shown in FIG. 2. Accordingly, it is possible to reduce the number of components.

Figure 6:
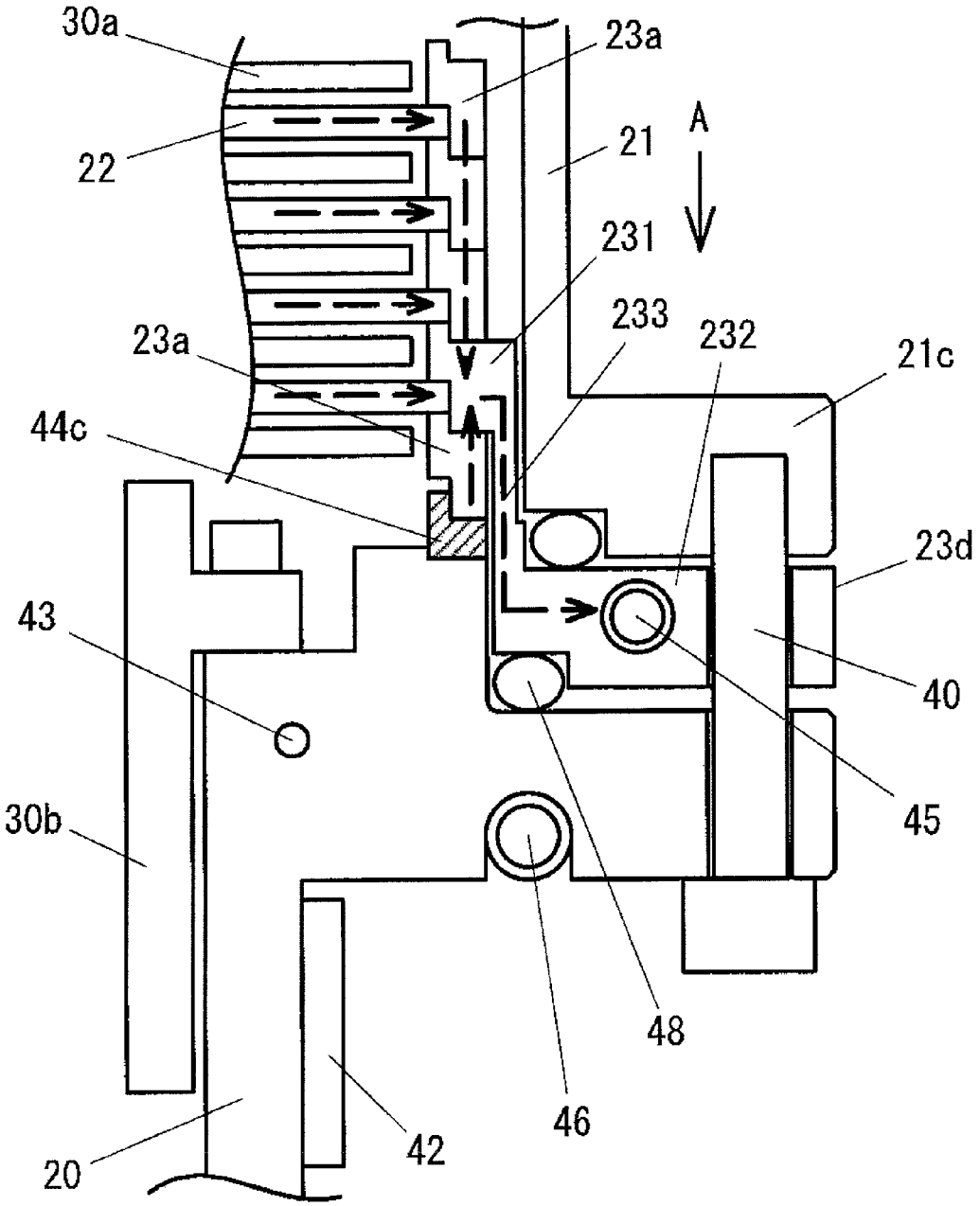
FIG. 6 is a diagram showing a second modification of the cooling spacer.

FIG. 6 is a diagram showing a second modification of the cooling spacer 23*b*. In the second modification, a cooling spacer 23*d* constitutes a second spacer from a base side. The cooling spacer 23*d* includes a spacer section 231 which functions as a spacer, a flange section 232 in which a spacer cooling pipe 45 is provided, and a cylindrical coupling section 233 which couples the spacer section 231 and the flange section 232 to each other.

A plurality of stages of stationary blades 22 are positioned by a plurality of spacers 23*a* and the spacer section 231. Thus, a ring-like heat insulation member 44*c* is arranged between the first spacer 23*a* from the base side and the base 20. Further, a gap is formed between the flange section 232 and the base 20 without providing a heat insulation member therebetween. Heat of the stationary blades 22 and the spacers 23*a* is transferred to the spacer section 231 of the cooling spacer 23*d* as indicated by broken line arrows, and released into coolant inside the spacer cooling pipe 45 through the coupling section 233 and the flange section 232.

Figure 7:
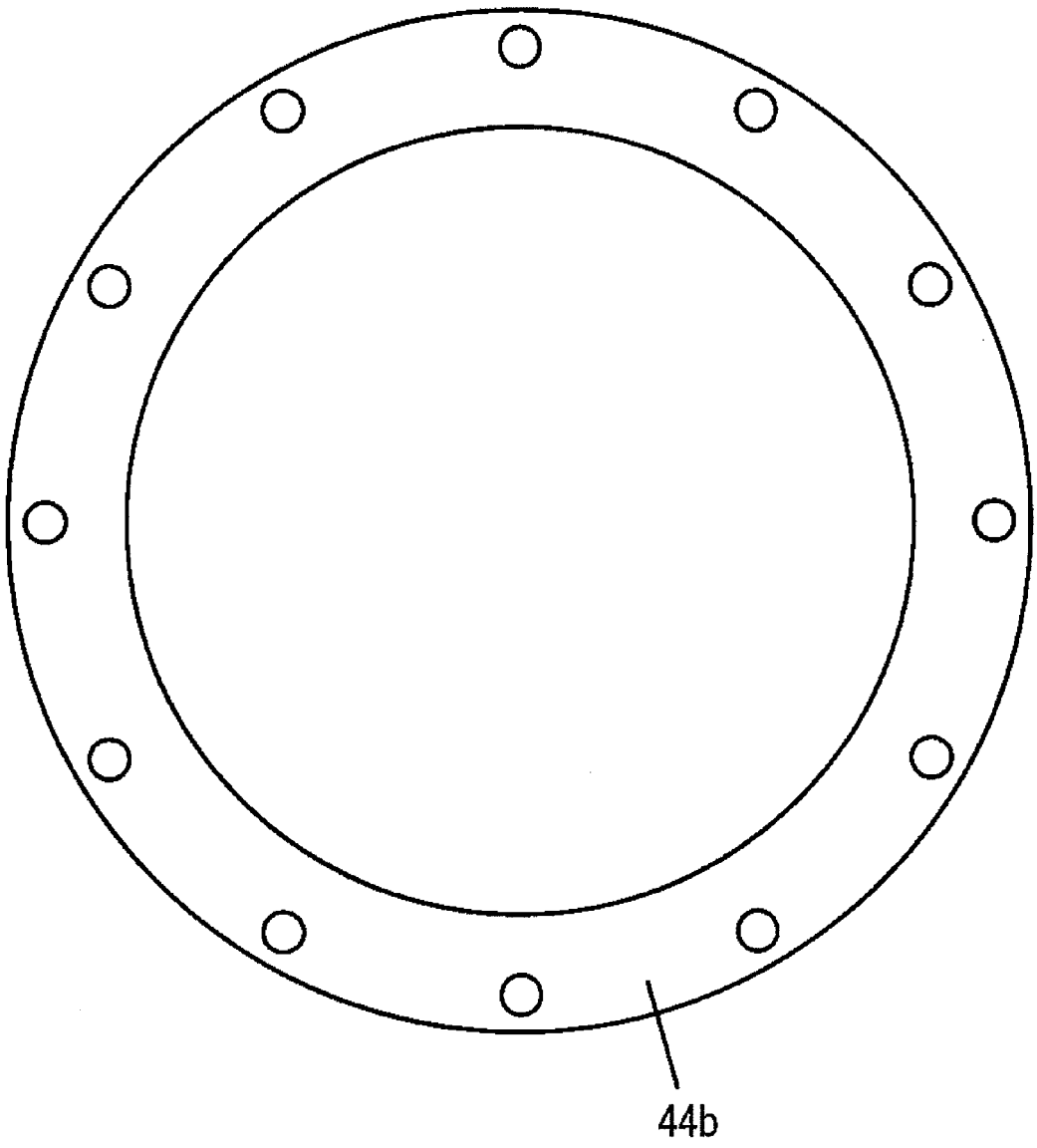
FIG. 7 is a plan view of a ring-like washer.

In the example shown in FIG. 2, the plurality of heat insulation washers 44 are attached to the respective bolts 40 as the heat insulation member arranged between the cooling spacer 23*b* and the base 20. However, instead of the heat insulation washers 44, a ring-like heat insulation washer 44*b* as shown in FIG. 7 may be used. Further, instead of arranging the heat insulation washers 44 or the heat insulation washer 44*b*, a heat insulation layer made of, for example, a resin may be formed on a surface of the base 20, the surface facing the cooling spacer 23*b*, or on a surface of the cooling spacer 23*b*, the surface facing the base 20.

Figure 8:
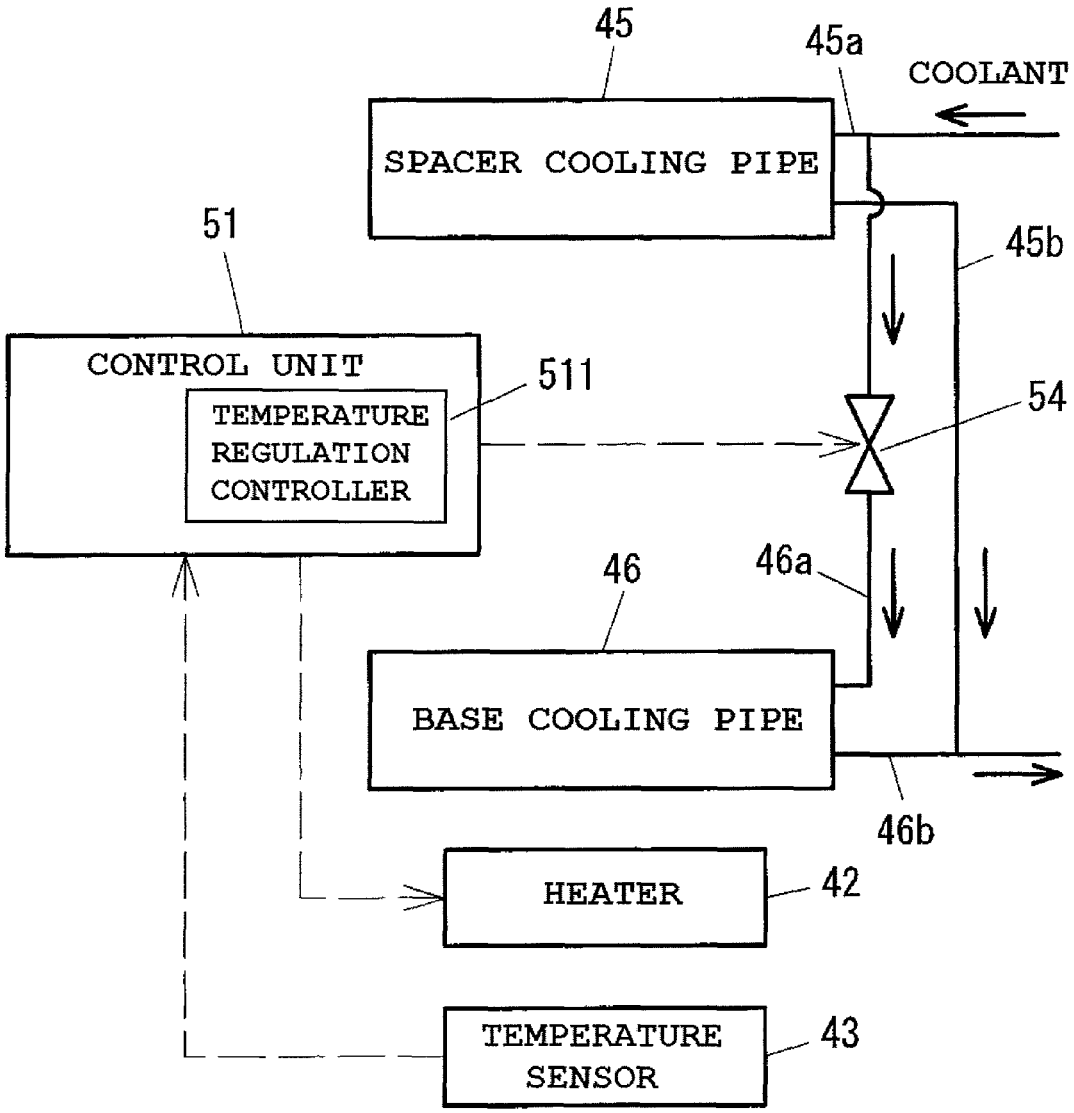
FIG. 8 is a diagram showing a case in which an on-off valve 54 is used in a cooling piping system.

In the configuration shown in FIG. 4, the three-way valve 52 is used in the cooling piping system. However, a configuration as shown in FIG. 8 may also be employed. The coolant supply section 45*a* of the spacer cooling pipe 45 and the coolant supply section 46*a* of the base cooling pipe 46 are connected to each other through an on-off valve 54. The temperature regulation controller 511 controls opening/closing of the on-off valve 54 based on a temperature detected by the temperature sensor 43. Specifically, the on-off valve 54 is closed when only cooling by the spacer cooling pipe 45 is performed. On the other hand, the on-off valve 54 is opened when temperature regulation and cooling by the spacer cooling pipe 45 are performed. The other control operations are performed in the same manner as in the configuration shown in FIG. 4.

Figure 9:
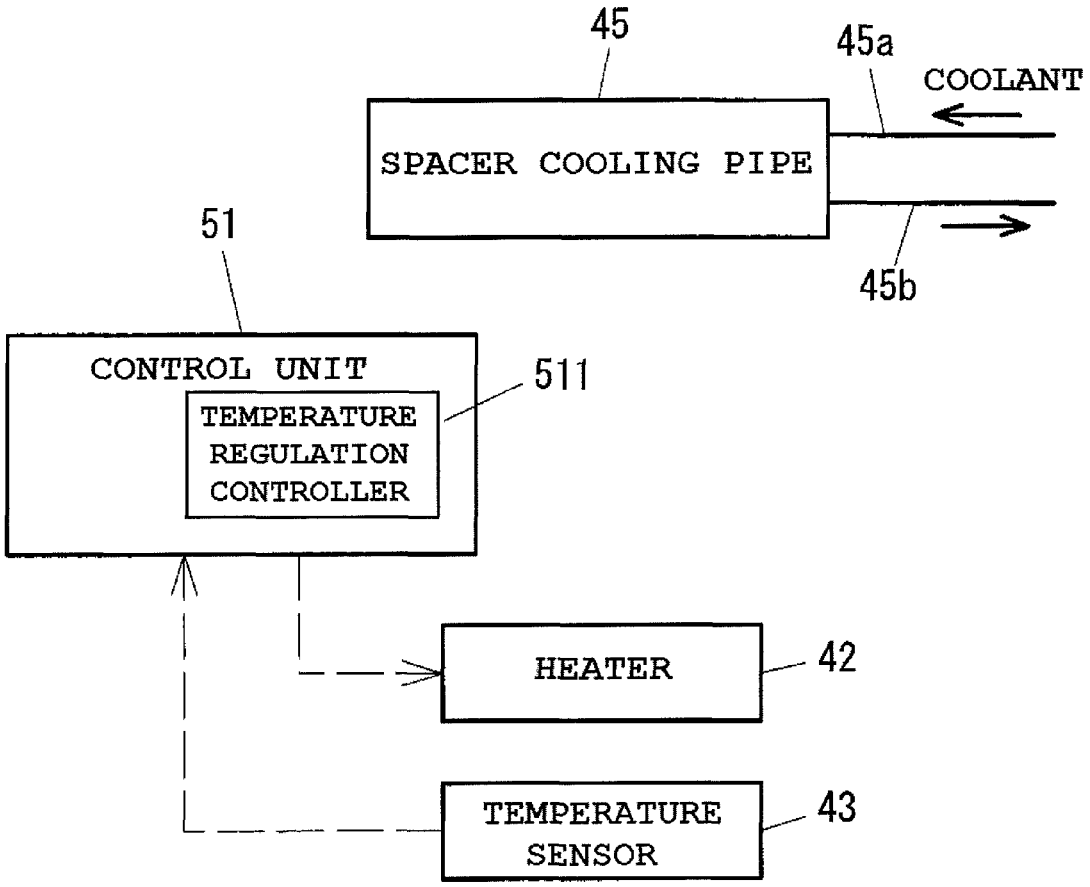
FIG. 9 is a diagram showing a temperature regulation device provided with no base cooling pipe 46.

When the flow rate of gas to be discharged is not so high, it is possible to perform the temperature regulation for the screw stator 24 by a temperature regulation device provided with no base cooling pipe 46 as shown in FIG. 9. A mechanism for cooling the stationary blades 22 is the same as one shown in FIG. 2.

In the example shown in FIG. 2, the temperature sensor 43 is arranged on the base 20. However, the temperature sensor 43 may be arranged on the screw stator 24. Such a configuration enables the temperature of the screw stator 24 to be more accurately detected.

In the cooling spacer 23*b* shown in FIG. 3, the spacer cooling pipe 45 is arranged within the groove 234. However, a method for forming a flow passage of coolant in the cooling spacer 23*b* is not limited thereto. For example, the cooling spacer 23*b* may be formed by aluminum casting, and the spacer cooling pipe 45 may be embedded in the cooling spacer 23*b* during the casting.

As described above, in the turbo-molecular pump of the present embodiment, the spacer cooling pipe 45 is provided in one of the spacers arranged on the base side for positioning the stationary blades 22, that is, in the cooling spacer 23*b*. The cooling spacer 23*b* is cooled by coolant flowing inside the spacer cooling pipe 45. Further, arranging the heat insulation washers 44 between the cooling spacer 23*b* arranged on the base 20 and the base 20 prevents heat from flowing from the base 20 which is in a high temperature state by the temperature regulation to the cooling spacer 23*b*. Accordingly, it is possible to effectively cool the stationary blades 22 and also heat the screw stator 24 by the temperature regulation. As a result, it is possible to increase the exhaust flow rate and prevent the accumulation of the reaction product on the screw stator 24.

The meaning of "the spacers arranged on the base side" is as follows. For example, in the example shown in FIG. 1, ten stages of spacers in total including the spacers 23*a* and the cooling spacer 23*b* are provided. In this case, the lower five spacers are the base-side spacers. When nine stages of spacers in total are provided, the lower four spacers are the base-side stators.

The cooling spacer 23*b* is provided for the purpose of cooling the stationary blades 22. In order to reduce heat flowing from the base 20 toward the stationary blades 22 as far as possible, the cooling spacer 23*b* is preferably disposed on the lowest stage of the spacers 23*a*, 23*b*, that is, at the nearest position to the base side. It is needless to say that the cooling spacer 23*b* may also be arranged at a position other than the lowest stage by arranging the heat insulation member 44*c* between the spacer 23*a* and the base 20 as shown in FIG. 8. Further, two or more cooling spacers 23*b* may be provided.

As shown in FIGS. 2 and 3, the outer side of the flange section 232 provided with the spacer cooling pipe 45 is arranged on the atmospheric side with respect to the vacuum seals 47 and 48. The coolant supply section 45*a* and the coolant discharge section 45*b* of the spacer cooling pipe 45 are arranged on this part of the atmospheric side. Thus, it is possible to easily connect pipes for coolant.

Further, it is possible to regulate the temperature of the screw stator 24 at a temperature that can prevent the reaction product accumulation by disposing the base cooling pipe 46 on the base 20, turning ON or OFF the heater 42 based on a temperature detected by the temperature sensor 43, and controlling the switching of the three-way valve 52 which performs ON/OFF of inflow of the coolant into the base cooling pipe 46. As a result, it is possible to prevent the accumulation of the reaction product on the screw stator 24.

Further, there is further provided the three-way valve 52 to which the coolant discharge section 45*b* of the cooling spacer 23*b*, the coolant supply side 46*a* of the base cooling pipe 46, and the bypass pipe 53 which bypasses the base cooling pipe 46 are connected, the three-way valve 52 switching the inflow destination of coolant discharged from the cooling spacer 23*b* between the coolant supply side 46*a* of the base cooling pipe 46 and the bypass pipe 53. Accordingly, it is possible to integrate coolant supply lines to the turbo-molecular pump into a signal line.

Using the heat insulation washers 44 as a member for thermally insulating the base 20 and the cooling spacer 23*b* from each other as shown in FIG. 2 results in a configuration having excellent assemblability. For example, when the diameter of the case 21 changes, the number of bolts 40 also changes. However, even in such as case, it is possible to easily cope with the change in the number of bolts 40 merely by changing the number of heat insulation washers 44. In order to reliably prevent contact between the bolts 40 and the cooling spacer 23*b*, a heat insulation member may be arranged in a gap between each of the bolts 40 and the cooling spacer 23*b*, or each of the heat insulation washers 44 may be formed in a shape that is partially inserted into the bolt hole of the cooling spacer 23*b*.

The above description is merely an example. Therefore, the present invention is not limited at all to the above embodiment unless the features of the present invention are impaired.

The invention claimed is:

1. A turbo-molecular pump comprising:

a rotor having a plurality of stages of rotor blades and a cylindrical section;

a plurality of stages of stationary blades alternately arranged with respect to the plurality of stages of rotor blades;

a stator arranged with a gap from the cylindrical section;

a plurality of spacers stacked on a base to which the stator is fixed, and positioning the plurality of stages of stationary blades;

a heater disposed on the base;

a temperature sensor for detecting a temperature of the stator; and a temperature regulation section for on/off controlling the heater based on a temperature detected by the temperature sensor to regulate the temperature of the stator so as to be a reaction product accumulation prevention temperature, wherein at least one spacer included in and arranged on a base side of the plurality of spacers is cooled by coolant, the turbo-molecular pump further comprises a heat insulation member disposed between the base and the spacer arranged on the base side, and a coolant supply section and a coolant discharge section from a first coolant flow passage are arranged on a pump atmospheric side.

2. The turbo-molecular pump according to claim 1, further comprising a base cooling section having a second coolant flow passage through which coolant flows, and cooling the base, wherein the temperature regulation section controls ON/OFF of the heater and the amount of coolant supplied to the base cooling section based on a temperature detected by the temperature sensor to regulate the temperature of the stator.

3. The turbo-molecular pump according to claim 2, further comprising a three-way valve to which the coolant discharge section of the first coolant flow passage, a coolant supply side of the second coolant flow passage, and a coolant pipe bypassing the second coolant flow passage are connected, switching inflow destination of coolant discharged from the coolant discharge section of the first coolant flow passage between the coolant supply side of the second coolant flow passage and the coolant pipe bypassing the second coolant flow passage, wherein the temperature regulation section switches the three-way valve to the coolant pipe and turns ON the heater when a temperature detected by the temperature sensor is less than the reaction product accumulation prevention temperature, and the temperature regulation section switches the three-way valve to the coolant supply side of the second coolant flow passage and turns OFF the heater when a temperature detected by the temperature sensor is equal to or more than the reaction product accumulation prevention temperature.

4. The turbo-molecular pump according to claim 1, wherein the spacer located nearest to the base of the plurality of spacers stacked on the base is cooled by coolant.

5. A turbo-molecular pump comprising:

a rotor having a plurality of stages of rotor blades and a cylindrical section;

a plurality of stages of stationary blades alternately arranged with respect to the plurality of stages of rotor blades;

a stator arranged with a gap from the cylindrical section;

a plurality of spacers stacked on a base to which the stator is fixed, and positioning the plurality of stages of stationary blades;

a heater disposed on the base;

a temperature sensor for detecting a temperature of the stator; and a temperature regulation section for on/off controlling the heater based on a temperature detected by the temperature sensor to regulate the temperature of the stator so as to be a reaction product accumulation prevention temperature, wherein at least one spacer included in and arranged on a base side of the plurality of spacers is cooled by coolant, the turbo-molecular pump further comprises a heat insulation member disposed between the base and the spacer arranged on the base side, and the spacer located nearest to the base of the plurality of spacers stacked on the base is cooled by coolant, the turbo-molecular pump further comprising a pump case fixed to the base with fixation bolts, the pump case holding the plurality of spacers stacked on the base between the pump case and the base, wherein the heat insulation member is a heat insulation washer which is attached to the fixation bolts and arranged between the spacer cooled by the coolant and the base.

6. A turbo-molecular pump comprising:

a rotor having a plurality of stages of rotor blades and a cylindrical section;

a plurality of stages of stationary blades alternately arranged with respect to the plurality of stages of rotor blades;

a stator arranged with a gap from the cylindrical section; and a plurality of spacers stacked on a base to which the stator is fixed, and positioning the plurality of stages of stationary blades;

wherein at least one spacer included in and arranged on a base side of the plurality of spacers is a cooling spacer cooled by coolant, the cooling spacer includes a spacer section stacked together with the other spacers and a cooling section having a ring-like groove which houses a cooling pipe in which the coolant flows, and the turbo-molecular pump further comprising the ring-like cooling pipe housed in the ring-like groove and including a coolant supply section and a coolant discharge section arranged on a pump atmospheric side.

* * * * *